US005724904A

United States Patent [19]

Kondo et al.

[11] Patent Number: 5,724,904

[45] Date of Patent: Mar. 10, 1998

[54] SEWING MACHINE CONTROL DEVICE WITH AN INVERTER FOR CONTROLLING AN INDUCTION MOTOR

[75] Inventors: Ikuzo Kondo, Chita; Yoshiharu Higuchi, Yokkaichi; Kazuhisa Ito, Aichi-ken, all of Japan

[73] Assignee: Brother Kogyo Kabushiki Kaisha, Nagoya, Japan

[21] Appl. No.: 762,144

[22] Filed: Dec. 9, 1996

[30] Foreign Application Priority Data

Dec. 8, 1995 [JP] Japan ..... 7-320737

[51] Int. Cl.[6] ..... D05B 69/18

[52] U.S. Cl. ..... 112/277

[58] Field of Search ..... 112/277, 275, 112/220, 221, 470.01, 470.04, 475.01

[56] References Cited

U.S. PATENT DOCUMENTS

| | | | |
|---|---|---|---|
| 4,627,370 | 12/1986 | Nakamura | 112/275 |
| 4,676,180 | 6/1987 | Neki et al. | 112/277 |
| 5,284,104 | 2/1994 | Hori et al. | 12/470.04 |

*Primary Examiner*—Peter Nerbun

*Attorney, Agent, or Firm*—Oliff & Berridge, PLC

[57] ABSTRACT

A sewing machine control device performs a closed loop control of an induction motor without using an encoder for detecting the motor speed. The control device includes an inverter for driving the induction motor, and controls the inverter output so that the actual speed of the motor is brought into coincidence with a target speed instructed from a speed instruction device. When the control device executes the inverter control, it uses not only the target speed fed from the speed instruction device but also a detection signal generated from a needle position detector that represents the position of a needle bar and the moving speed thereof.

13 Claims, 3 Drawing Sheets

SEWING MACHINE CONTROL DEVICE WITH AN INVERTER FOR CONTROLLING AN INDUCTION MOTOR

BACKGROUND OF THE INVENTION

1. Field of the Invention

The present invention relates to a sewing machine control device for controlling a sewing machine including an induction motor as a drive motor.

2. Description of Related Art

A conventional sewing machine control device includes an inverter which is used as a driving circuit for an induction motor. The inverter controls the induction motor to start, stop and change its rotational speed according to instructions received from a foot pedal depressed by an operator. The inverter converts a DC voltage converted from a commercial AC voltage to an AC voltage in the form of a sinusoidal waveform having a predetermined frequency and a predetermined voltage. The resultant AC voltage is supplied to the induction motor as a driving signal.

More specifically, the sinusoidal AC currents having different phases are flowed in the respective phase windings of the induction motor so that the induction motor rotates at a speed and with a torque in accordance with the voltage and frequency of the drive signal. For example, three AC currents different In phase by 120 degrees are applied to the three phase windings of a three-phase induction motor, respectively. In the sewing machine controlling device, the voltage and frequency of the inverter is controlled in accordance with a speed instruction supplied from the foot pedal.

Generally, either an open loop control or a closed loop control is employed when it is attempted to control the rotational speed of the induction motor by controlling the output of the inverter. In the open loop control, the output frequency is set to correspond to a target speed, and based on the output frequency thus set and a predetermined voltage versus frequency characteristic, the output voltage of the inverter is set. In the closed loop control, the actual rotational speed of the induction motor is detected with an encoder attached thereto, and the output of the inverter is corrected in accordance with a deviation between the actual rotational speed and a target speed.

When the inverter output is controlled through the open loop control in accordance with the fixed voltage versus frequency characteristic, the torque of the induction motor is too weak when it is rotating at a low speed. Consequently, a workpiece fabric cannot be stitched under a stable condition. If the output voltage of the inverter is increased during the rotations at the low speed in order to increase the torque, an overcurrent flows in the induction motor causing it to generate heat.

When the inverter output is controlled through the closed loop control, a stale driving of the induction motor can be attained because the inverter output is being controlled based on a deviation between the actual speed and the target speed. Accordingly, stitching can be performed under a good condition. However, the use of the encoder for detecting the actual speed of the motor increases the cost of the sewing machine control device.

SUMMARY OF THE INVENTION

The present invention has been made in view of the foregoing, and accordingly, it is an object of the present invention to provide a sewing machine control device in which a closed loop control of an induction motor can be accomplished without need for the provision of an encoder In order to achieve the above and other objects there is provided a sewing machine control device which includes an induction motor for driving a sewing machine, the sewing machine having a needle bar movably disposed at a position and moving at a moving speed: an inverter for driving the induction motor, the inverter outputting an AC driving signal having a voltage and a frequency: a speed instruction device for outputting a speed instruction signal indicative of a target speed of the induction motor; a needle position detector for generating a detection signal indicative of the position and the moving speed of the needle bar, the moving speed of the needle bar being correlated with an actual speed of the induction motor; and a control unit for controlling the inverter based on the detection signal generated from the needle position detector and the speed instruction signal output from the speed instruction device so that the actual speed of the induction motor is brought into coincidence with the target speed of the induction motor.

As described above, the present invention is provided with an inverter for driving the induction motor as in the conventional device. The control unit of the present invention controls the inverter so that the actual speed of the induction motor is brought into coincidence with the target speed instructed from the speed instruction device. When this control unit executes this inverter control, it uses not only the instruction speed from the speed instruction device but also the detection signal generated from the needle position detector depending on the needle position and the moving speed of the needle bar. Accordingly, an encoder needs not be provided to the induction motor as in the conventional device, but the control unit is capable of executing a control similar to a closed loop control using the encoder.

When controlling the sewing machine, various kinds of controls need to be executed, which include not only the speed control of the induction motor but also a stop position control for stopping the sewing machine at a predetermined needle position, and a control for executing a predetermined stitching operation in which the sewing machine is driven to perform a predetermined number of stitches. The sewing machines which can execute such controls are provided with the needle position detector for detecting the needle position. The present invention utilizes such a needle position detector generally provided in electrically controlled sewing machines to indirectly detect the rotational speed of the induction motor. A such without additionally providing the encoder to the induction a motor, a closed loop control of the induction motor can be established. Therefore, the problems such that the torque of the induction motor is lowered when it is rotating at a lower speed and heat is generated from the induction motor can be solved without increasing the cost as compared with the conventional control device of the sewing machine employing an open loop control.

The control unit of the present invention includes deviation computing means for computing the actual speed of the sewing machine based on the detection signal generated from the needle position detector, and for computing a deviation between the actual speed of the sewing machine and the target speed of the sewing machine; basic frequency setting means for setting a basic frequency of the AC driving signal output from the inverter based on the target speed of the sewing machine; output frequency setting means for correcting the basic frequency based on the actual speed of the sewing machine computed by the deviation computing means and the target speed of the sewing machine, and for setting an output frequency of the inverter; and output voltage setting means for setting the output voltage of the inverter based on the output frequency of the inverter set by the output frequency setting means so that the output frequency of the inverter and the output voltage of the inverter comply with a predetermined relation between the voltage and the frequency of the AC driving signal, wherein the control unit controls the inverter so that the AC drive signal output from the inverter has the output frequency and the output voltage.

A load imposed on the induction motor does not remain the same. For example, it differs when the needle is at the lower position where it sticks into a workpiece fabric and when the needle is lifted above the workpiece fabric at a position in the vicinity of the upper bed position. In this manner, the load imposed on the induction motor changes depending on the needle position. An amount of change in the load differs depending on a material or thickness of the work piece fabric. In the conventional control device effecting the open loop control, there are problems such that the torque of the induction motor cannot be controlled depending of the variation in the load.

To carry out the closed loop control of the induction motor, the present invention basically controls the AC driving voltage in accordance with a predetermined voltage versus frequency characteristic as is used in a conventional device for carrying out an open loop control. The present invention controls the output frequency and output voltage of the inverter to be a value dependent on this speed deviation by correcting the output frequency so as to correspond to the target speed in accordance with the deviation between the actual speed end the target speed of the sewing machine. Therefore, even if the load imposed on the induction motor changes depending on the needle position and thus the actual speed of the sewing machine is changed, the output of the inverter can be changed corresponding to the speed change. Accordingly, the output torque of the induction motor can be properly controlled corresponding to the stitching condition of the workpiece fabric. The induction motor does not generate heat and is driven at a constant speed depending on the instruction supplied from the speed instruction device.

In this manner, the sewing machine can be driven at a constant speed, so the vibration of the sewing machine which may be generated caused by the variation of the load during stitching can be suppressed. Because of the capability of suppressing the vibration, the operator is no longer annoyed with the vibration of the sewing machine and hence the operational efficiency can be improved.

In order to prevent the rotational variation of the sewing machine caused by the variation in the load which occurs depending on the needle position of the sewing machine, it is not only required that the actual speed of the sewing machine be provided based on the detection signal from the needle position detector. For example, upon computing a basic voltage of the inverter output based on the basic frequency obtained from the target speed and also a predetermined voltage versus frequency characteristic, both the basic frequency and the basic voltage may be corrected. Specifically because the level of the load imposed on the induction motor can be predicted if the needle position is known, a correction value for correcting the basic frequency and the basic voltage corresponding to with the needle position. When the sewing machine is being driven, a correction value is read out of the correction data in correspondence with the needle position to thereby correct the basic frequency and the basic voltage. The rotational variation of the sewing machine can thus be suppressed. In this case, the load imposed on the induction motor varies depending on the material and the thickness of the workpiece fabric. Therefore, it is desirable to provide a sensor for sensing such information in order to attain a high control accuracy.

In the sewing machine control device according to the present invention, the deviation computing means computes the output frequency of the AC drive signal corresponding to the actual speed of the sewing machine based on the detection signal generated from the needle position detector, and computes a frequency deviation between the output frequency computed by the deviation computing means and basic frequency, the computed frequency deviation representing a speed deviation between the actual speed of the sewing machine and the target speed of the sewing machine, and wherein the output frequency setting means corrects the basic frequency based on the frequency deviation computed by the deviation computing means and sets the output frequency of the inverter.

The output speed setting means corrects the basic frequency based on the frequency deviation thus computed by the deviation computing means, and sets the output frequency of the inverter. Because the speed of the sewing machine corresponds substantially perfectly to the output frequency of the inverter if a delay of a control system is neglected, it is possible to replace the speed of the sewing machine with the output frequency of the inverter or the output frequency of the inverter with the speed of the sewing machine. In view of this, the deviation computing means may compute the frequency of the inverter based on the detection signal. A frequency of deviation between the thus computed frequency and the basic frequency corresponding to the target speed is set as a value representative of the speed deviation between the target speed and the actual speed of the sewing machine. In the output frequency setting means, the basic frequency is corrected using the frequency deviation in lieu of the speed deviation.

The speed instruction device according to the present invention instructs the target speed of the sewing machine in accordance with a depressed amount of the foot pedal. In the sewing machine having an automatic stitching capability in which a workpiece fabric is automatically stitched by performing a predetermined number of stitches and a predetermined amount of feeding of the workpiece fabric, there are provided storage means for storing a predetermined speed data and retrieving means for retrieving the predetermined speed data from the storage means. For such a sewing machine, the speed instruction device instructs the target speed of the sewing machine based on the predetermined speed data retrieved by the retrieving means. For the sewing machine provided with a manual operation lever lieu of the foot pedal, the speed instruction device must have a function to detect an amount of manipulation of the operation lever and to output the target speed corresponding to the amount of manipulation thus detected.

BRIEF DESCRIPTION OF THE DRAWINGS

The particular features and advantages of the invention as well as other objects will become more apparent from the following description taken in connection with the accompanying drawings, in which.

DETAILED DESCRIPTION OF THE PREFERRED EMBODIMENTS

Figure 1:
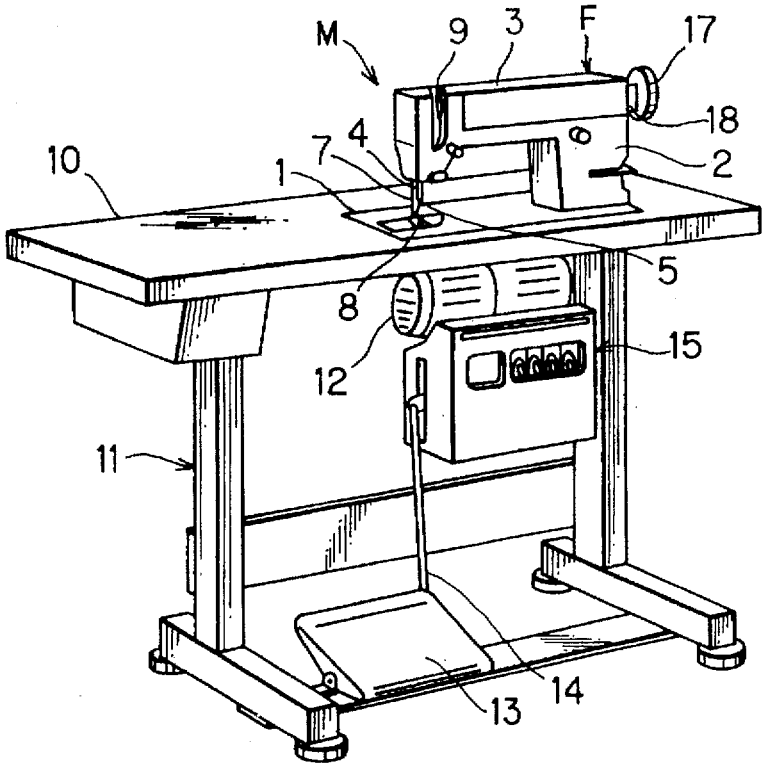
FIG. 1 is a perspective view showing an arrangement of a lock stitch sewing machine for an industrial use according to an embodiment of the present invention.

A sewing machine control device according to a preferred embodiment of the present invention will be described while referring to the accompanying drawings. FIG. 1 shows a lock stitch sewing machine for an industrial use. The structure of the lock stitch sewing machine is similar to that of an industrial sewing machine, so it will be described briefly.

As shown in FIG. 1, a lock stitch sewing machine M for an industrial use (hereinafter referred simply to as "sewing machine") includes a bed portion 1 formed on a working table 10, a column portion 2 provided with an upright posture at the right tip portion of the bed portion 1 as viewed in FIG. 1, and an arm portion 3 extending from the column portion 2 leftward as viewed in FIG. 1 in parallel with the bed portion 1.

Although not shown in the drawings, there are provided in the bed portion 10 a feed dog vertical movement mechanism for vertically driving a feed dog; a feed dog horizontal movement mechanism for horizontally driving the feed dog an automatic thread cutter for cutting a needle thread and a bobbin thread at a time of completion of stitching, and a thread loop capturing mechanism. Also, the arm portion 3 is provided with a needle bar drive mechanism for vertically driving a needle bar 4 with a needle 5 mounted to its lower tip; and a thread take up lever mechanism (not shown) for vertically driving a take up thread lever 9 in timed relation to vertical drive of the needle bar 4. An induction motor 12 drives the feed dog vertical movement mechanism, the feed dog horizontal movement mechanism, the needle bar drive mechanism, and the thread take up lever mechanism through a main shaft (not shown) provided in the arm portion 3.

A manual pulley 17 is rotatably provided at the right side of the arm portion 3. The main shaft can be manually rotated with the manual pulley 17. A needle position detector 18 is provided at the top portion of the column portion 2 for detecting the position of the needle bar 4 and the moving speed of the needle bar 4. Detection signals output from the needle position detector 18 are applied to a control box 15 containing a control device for controlling the drive of the induction motor 12. A pressing bar 7 is vertically movably supported on a machine frame F at the rear side of the needle bar 4, and a pressure foot 8 is attached to the lowermost end of the pressing bar 7.

When the needle bar 4 has reached the uppermost position and the lowermost position, the needle position detector or 18 generates needle position detecting signals representative of the positions of the needle bar 4. The needle position detector 18 also generates a speed detection signal representative of the speed of the needle bar 4 during the vertical movement of the needle bar 4. The speed detection signal is generated at every predetermined displacement of the needle bar 4. Thus, the control box 15 is capable of knowing the needle position from the needle position detection signal, and an actual speed of the sewing machine M from the speed detection signal.

The induction motor 12 is disposed immediately below a work table 10 and is fixedly secured to a work stand 11 supporting the work table 10. The control box 15 is disposed below the induction motor 12 and is fixedly secured to the work stand 11. In the lower portion off the work stand 11, a foot pedal 13 is swingably supported and is used for the operation of the sewing machine M. A vertically extending connection rod 14 has a lower portion connected to the foot pedal 13 and an upper portion connected to the speed instruction device 20 (see FIG. 2) housed in the control box 15. The foot pedal 13 is swingable back and forth between a frontwardly depressed position and a rearwardly depress position with respect to a neutral position in which the foot pedal 13 is held horizontally. When the foot pedal 13 is depressed frontwardly, the speed instruction device 20 outputs a start signal causing the induction motor 12 to start rotation. When the foot pedal 13 is further depressed into a deeper level, the speed instruction device 20 outputs a speed instruction signal corresponding to the amount of depression. When the foot pedal 13 returns to the neutral position, the speed instruction device 20 outputs a stop signal causing the induction motor 12 to stop rotation. When the foot pedal 13 is depressed rearwardly, the speed instruction device 20 outputs a thread cut instruction signal.

Figure 2:
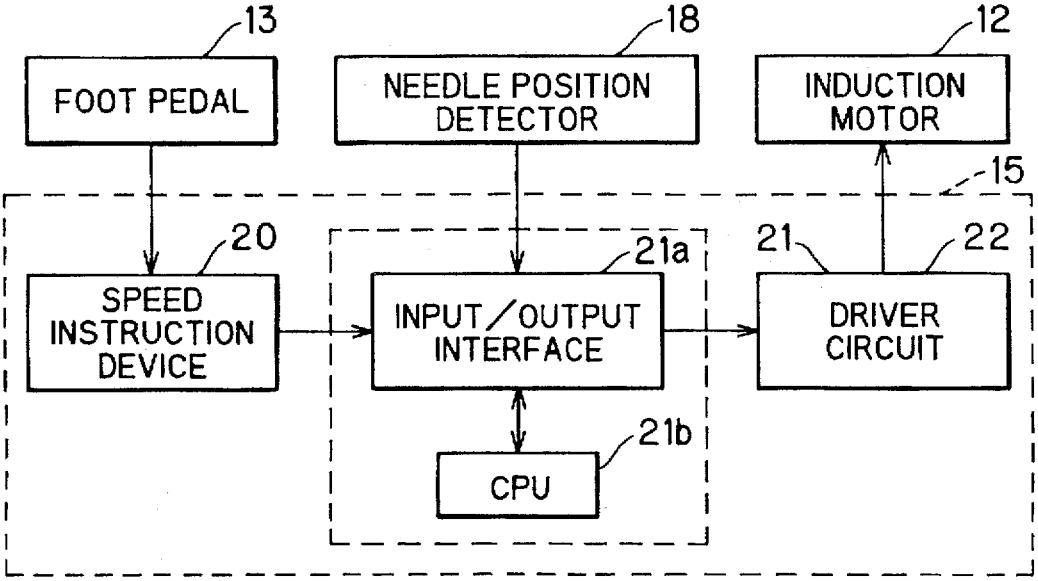
FIG. 2 is a block diaphragm showing an arrangement of a sewing machine control device according to the embodiment of the present invention.

As shown in FIG. 2, the sewing machine control device includes the foot pedal 13, the needle position detector 18, the induction motor 12, the speed instruction device 20 connected to the foot pedal 13, a control unit 21, and a driver circuit 22 for driving the induction motor 12. The speed instruction device 20, the control unit 21, and the driver circuit 22 are provided in the control box 15. The control unit 21 includes an input/output interface 21*a* and a one tip microcomputer 2l*b* including a central processing (CPU), a read only memory (ROM), and a random access memory (RAM).

Figure 3:
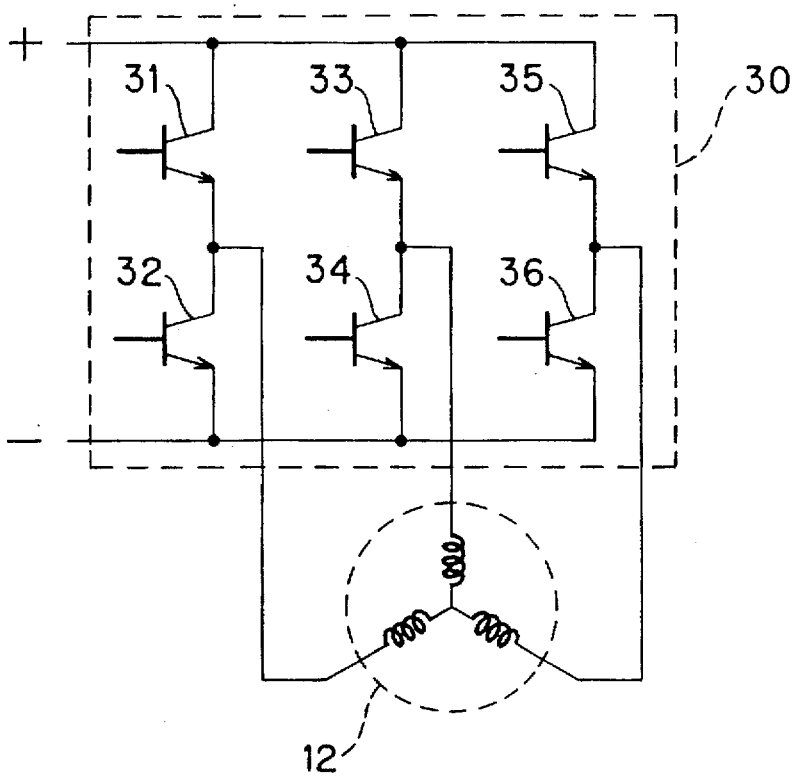
FIG. 3 is a circuit diaphragm showing an arrangement of an inverter provided in a driving circuit of an induction motor.

The input/output interface 21*a* is applied with the start signal, the speed instruction signal, and the stop signal from the speed instruction device 20. Also, the input/output interface 21 is applied with the needle bar detection signal and the speed detection signal from the needle position detector 18. The input/output interface 21*a* outputs a control signal to the driver circuit 22 which drives the induction motor 12. The control unit 21 computes a control amount for controlling the induction motor 12 based on the signals applied to the input/output interface 21*a*. The control signal output to the driver circuit 22 is representative of the computed results. The driver circuit 22 supplies three-phase AC currents having different phases to respective phase windings of the induction motor 12 in accordance with the control signal supplied from the control unit 21. As shown in FIG. 3, the driver circuit 22 includes a well known inverter 30 which is supplied with a DC voltage obtained through a full wave rectification of a commercial AC voltage. The inverter 30 applies three-phase AC voltages to the respective terminals of the induction motor 12.

The control unit 21 sequentially renders power transistors 31 through 36 provided in the inverter 30 ON and OFF in response to pulse width modulation signals (PWM signals). The inverter 30 outputs three-phase AC voltages having voltages and frequencies corresponding to the speed instruction signals including the start signal and the stop signal. The AC voltages are applied to the respective terminals of the induction motor 12. The microcomputer 21*b* incorporates a PWM signal generating circuit which generates the PWM signals for the PWM control. One tip microcomputers provided with a PWM signal generating capability is available on the market and thus is well known in the art, so a detailed description thereof will be omitted herein. Further, the PWM control applied to the inverter 30 for generating the AC voltages having a desired voltage and a desired frequency from the inverter 30 is also well known in the art, so the detailed description will not be necessary.

Figure 4:
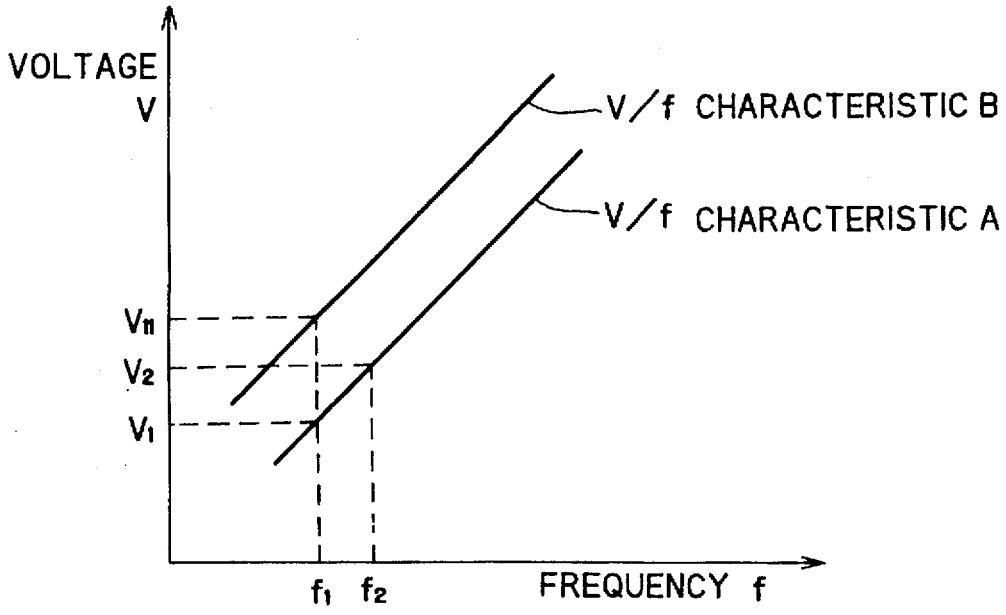
FIG. 4 is a graphical representation showing voltage versus frequency characteristics used in controlling the inverter.
Figure 5:
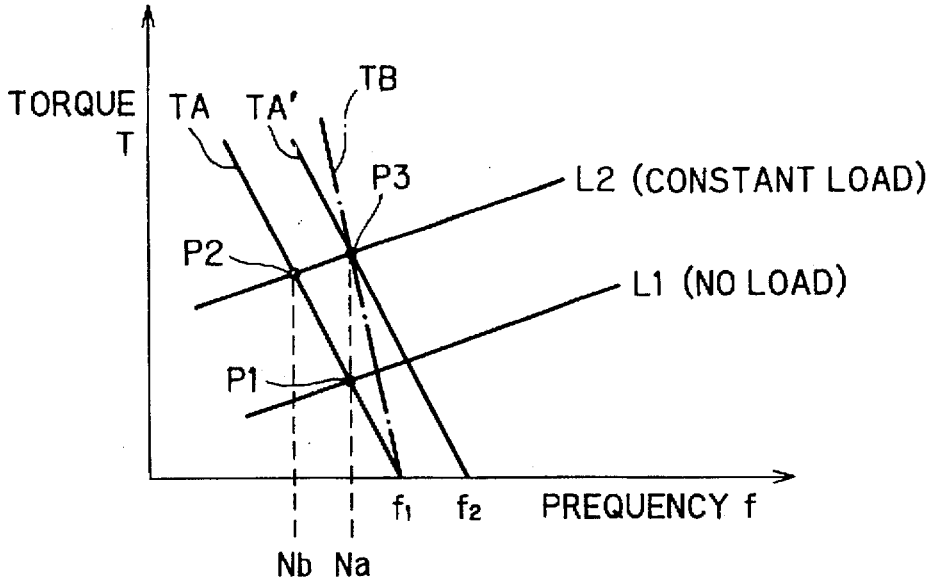
FIG. 5 is a graphical representation showing frequency versus torque characteristics of an induction motor.

Next, a description will be provided with respect to a sewing machine control process executed by the control unit 21 while referring to the graphs shown in FIGS. 4 and 5. FIG. 4 is a graph showing a voltage versus frequency characteristic used for driving the induction motor 12 in a conventional open loop control for the sewing machine. In the graph of FIG. 4, the axis of abscissas represents frequency f, and the axis of ordinates voltage V. FIG. 5 is a graph showing a frequency versus torque characteristic of the induction motor 12. In the graph of FIG. 5, the axis of abscissas represents frequency f, and axis of ordinates torque T.

Fist of all, the principle of the present invention will be described to facilitate the understanding of the present invention. In the control device of the sewing machine M, it is a general practice to control the output of the inverter so that a ratio of the voltage V to the frequency f is maintained at constant as shown in FIG. 4. When the V/f characteristic A shown in FIG. 4 is used for determining the relationship between frequency f and the voltage V, if the output frequency from the inverter 30 is set to a frequency f1 when the speed instruction signal from the speed instruction device 20 represents that the target speed (instruction speed) is na, the output voltage of the inverter 30 is set to a voltage V1. On the other hand, the frequency versus torque characteristic of the induction motor 12 is given by TA shown in FIG. 5. At this time, the relationship between the speed of the sewing machine M and a driving torque required for driving the sewing machine M with no load is given by a load characteristic curve L1. As shown in FIG. 5, the frequency versus torque characteristic curve TA of the induction motor 12 and the load characteristic curve L1 of the sewing machine M cross at point P1, whereby the actual rotational speed Na of the sewing machine M can be brought into coincidence with the instruction speed na.

However, if the load of the sewing machine M increases and the load characteristic curve is shifted from L1 to L2 as shown in FIG. 50 the coincidence point P1 is shifted to P2 and the actual speed of the sewing machine M decreases to Nb that is lower than the instruction speed na. In the case of the open loop control, because the frequency f1 is not changed, the speed of the sewing machine M is maintained at Nb.

If the V/f characteristic B shown in FIG. 4 is used in lieu of the characteristic A in order to prevent the speed lowering, the output voltage from the inverter 30 increases to V11, and the frequency versus torque characteristic curve of the induction motor 12 is shifted from TA to TB as shown in FIG. 5. As a result, the characteristic curves TB and L2 are brought into coincidence at point P3, so that the sewing machine M is driven at a speed of Na corresponding to the instruction speed na. However, if the relationship between the voltage and frequency of the inverter 30 is determined based on a condition in which a load is imposed on the sewing machine M, the voltage V11 is supplied to the induction motor 12 even in the case where the sewing machine M is being driven with no load, that is, the sewing machine is being driven along the load characteristic curve L1. Therefore, an overcurrent flows in the induction motor 12 and generates heat.

In the present embodiment, the V/f characteristic curve A shown in FIG. 4 is used throughout the control of inverter 30. This characteristic A is suitable for the sewing machine M when it is driven with no load. When the actual speed Nb of the sewing machine M indicated by The speed detection signal from the needle position detector 18 is lowered relative to the target speed Na (=na), the output frequency of the induction motor 12 is changed from f1 to f2 so that the speed of the sewing machine M returns to Na. By setting the output voltage of the inverter 30 by changing the output frequency of the inverter 30, the frequency versus to torque characteristic curve of the induction motor 12 is shifted from TA to TA', thereby causing to cross with the load curve L2 at point P3.

More specifically, according to the present embodiment, the output frequency of the inverter 30 set based on the target speed is changed depending on the deviation between the target speed and the actual speed of the sewing machine M. By so doing, the speed of the sewing machine M can be controlled to the target speed as instructed from the speed instruction device 20 without unduly increasing the output voltage of the inverter 30. Note that the voltage V2 is lower than the voltage V11 (see FIG. 4).

Figure 6:
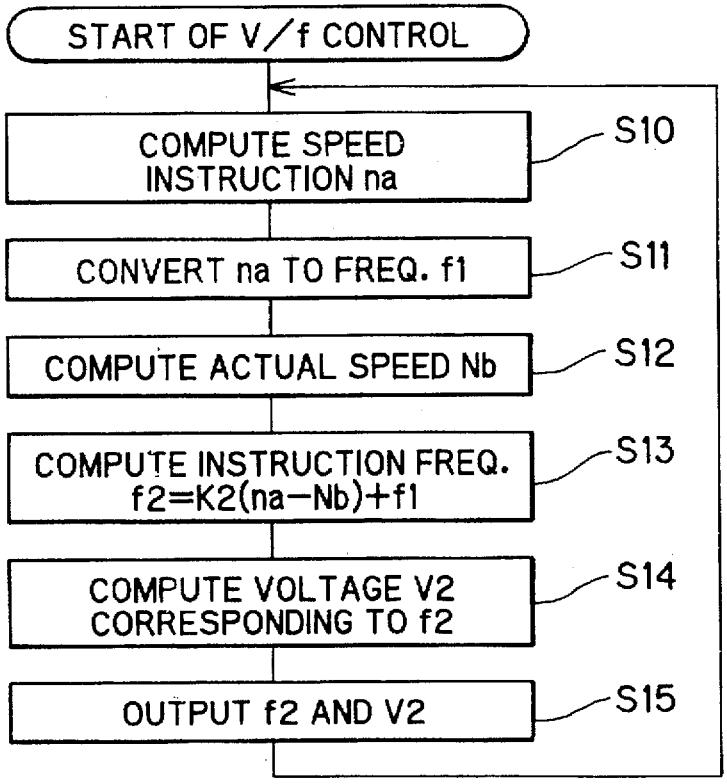
FIG. 6 is a flow chart illustrating a control process to be executed in a control device according to the embodiment of the present invention.

Next, the control process (voltage and frequency control of the inverter) to be executed by the control unit 21 will be described while referring to the flow chart shown in FIG. 6. In Sl0, the control unit 21 commutes the speed instruction na (the target speed of the sewing machine M) based on the speed instruction signal from the speed instruction device 20. In S11, the speed instruction value na is converted to a basic frequency f1 of the inverter 30. In S12, the control unit 21 computes the actual speed Nb of the sawing machine M based on the speed detection signal from the needle position detector 18. In S13, the control unit 21 computes a deviation (na−Nb) between the speed instruction value (target speed) na and the actual speed Nb, and multiplies a correction coefficient K2 to the resultant deviation. By adding the value K2 (na−Nb) to the basic frequency f1, the output frequency f2 for controlling the inverter 30 is set. In S13, according to an equation f2=K2 (na−Nb) +f1, the output frequency f2 of the inverter 30 is set. In this manner, the output frequency f2 of the inverter 30 is set. In S14, the control unit 21 computes the output voltage V2 of the inverter 30 corresponding to the frequency f2 based on the V/f characteristic A shown in FIG. 4. In S15, the frequency f2 and the voltage V2 obtained in S13 and S14 are output to the PWM signal generating circuit (not shown) which In turn outputs the control signal (PWM signal) to the inverter 30, so that the inverter 30 outputs an AC driving signal with frequency f2 and voltage V2, whereupon the routine returns to S10.

As described above, in the present embodiment, the output frequency and the output voltage of the inverter 30 are changed in accordance with the deviation between the actual speed Nb of the sewing machine M and the target speed na, therefore, the sewing machine M can be driven at the target speed na while optimally controlling the output torque of the induction motor 12 without generating heat. Further, in the present embodiment, the actual speed of the sewing motor is detected using the needle position detector 18 provided in the conventional sewing machine M. Therefore, an encoder is not necessary and thus the manufacturing cost will not increase. The present embodiment can control the sewing machine M so as to maintain the target speed even if the torque of the sewing machine M changes during stitching. Therefore, vibrations of the sewing machine caused by the fluctuation of the rotational speed can be effectively suppressed. The operator is no longer annoyed with the vibrations during stitching and hence operation efficiency is improved.

While only one exemplary embodiment of this invention has been described in detail, those skilled in the art will recognize that there are many possible modifications and variations which may be made in this exemplary embodiment while yet retaining many of the novel features and advantages of the invention. For example, the above-described embodiment is applied to a lock stitch sewing machine for an industrial use, however, the present invention is also applicable to the sewing machines including an induction motor as a driving motor and an inverter for controlling the same.

What is claimed is:

1. A sewing machine control device comprising:

an induction motor for driving a sewing machine, said sewing machine having a needle bar movably disposed at a position and moving at a moving speed;

an inverter for driving said induction motor, said inverter outputting an AC driving signal having a voltage and a frequency;

a speed instruction device for outputting a speed instruction signal indicative of a target speed of said induction motor;

a needle position detector for generating a detection signal indicative of the position and the moving speed of the needle bar, the moving speed of the needle bar being correlated with an actual speed of the sewing machine; and a control unit for controlling said inverter based on the detection signal generated from said needle position detector and the speed instruction signal output from said speed instruction motor is brought into coincidence with the target speed of the sewing machine, wherein said control unit comprises:

deviation computing means for computing the actual speed of the sewing machine based on the detection signal generated from said needle position detector, and for computing a deviation between the actual speed of the sewing machine and the target speed of the sewing machine;

basic frequency setting means for setting a basic frequency of the AC driving signal output from said inverter based on the target speed of the sewing machine; and output frequency setting means for setting an output frequency of said inverter upon correcting the basic frequency based on the actual speed of the sewing machine computed by said deviation computing means and the target speed of the sewing machine.

2. The sewing machine control device according to claim 1, wherein said control unit further comprises:

output voltage setting means for setting an output voltage of said inverter based on the output frequency of said inverter set by said output frequency setting means so that the output frequency of said inverter and the output voltage of said inverter comply with a predetermined relation between the voltage and the frequency of the AC driving signal, wherein said control unit controls said inverter so that the AC drive signal output from said inverter has the output frequency and the output voltage.

3. The sewing machine control device according to claim 2, wherein said deviation computing means computes the output frequency of the AC drive signal corresponding to the actual speed of the sewing machine based on the detection signal generated from said needle position detector, and computes a frequency deviation between the output frequency computed by said deviation computing means and the Basic frequency, the computed frequency deviation representing a speed deviation between the actual speed of the sewing machine and the target speed of the sewing machine, and wherein said output frequency setting means corrects the basic frequency based on the frequency deviation computed by said deviation computing means and sets the output frequency of said inverter.

4. The sewing machine control device according to claim 3, wherein the voltage and the frequency of the AC driving signal has such a predetermined relation that a ratio of a change of the frequency to a corresponding change of the voltage is at constant.

5. The sewing machine control device according to claim 1, wherein said speed instruction device instructs the target speed of the sewing machine in accordance with a manipulated amount of a manual operation level provided in the sewing machine.

6. The sewing machine control device according to claim 5, wherein the manual operation level is a foot pedal, wherein said speed instruction device instructs the target speed of the sewing machine in accordance with a depressed amount of said foot pedal.

7. The sewing machine control device according to claim 1, further comprising storage means for storing predetermined speed data, and retrieving means for retrieving the predetermined speed data from said storage means, wherein said speed instruction device instructs the target speed of the sewing machine based on the predetermined speed data retrieved by said retrieving means.

8. A sewing machine control device comprising:

a needle bar;

an induction motor;

an inverter for driving said induction motor, said inverter outputting an AC driving signal having a voltage and a frequency;

a speed instruction device for outputting a speed instruction signal indicative of a target speed of said induction motor;

a needle position detector for generating a detection signal indicative of the position and the moving speed of the needle bar, the moving speed of the needle bar being correlated with an actual speed of said induction motor;

first computing means for computing the target speed of said induction motor based on the speed instruction signal output from said speed instruction device;

converting means for converting the target speed of said induction motor to a basic frequency;

second computing means for computing the actual speed of said induction motor based on the detection signal generated from said needle position detector:

third computing means for computing an output frequency of said inverter in accordance with an equation given by $$f2=K2\ (na-Nb)+f1$$

where f2 is the output frequency of said inverter, na is the target speed of said induction motor, Nb is the actual speed of said induction motor, f1 is the basic frequency, and K2 is a correction coefficient;

fourth computing means for computing an output voltage of said inverter based on the output frequency of said inverter; and control means for controlling said inverter to output the AC driving signal having the output voltage and the output frequency from said inverter.

9. The sewing machine control device according claim 8, wherein the voltage and the frequency of the AC driving signal has such a predetermined relation that a ratio of a change of the frequency to a corresponding change of the voltage is at constant.

10. The sewing machine control device according to claim 8, wherein the sewing machine is a lock stitch sewing machine.

11. A method of controlling a sewing machine including:

a needle bar;

an induction motor;

an inverter for driving said induction motor, said inverter outputting an AC driving signal having a voltage and a frequency;

a speed instruction device for outputting a speed instruction signal indicative of a target speed of said induction motor; and a needle position detector for generating a detection signal indicative of the position and the moving speed of the needle bar, the moving speed of the needle bar being correlated with an actual speed of said induction motor, the method comprising the steps of:

(a) computing the target speed of said induction motor based on the speed instruction signal output from said speed instruction device;

(b) converting the target speed of said induction motor to a basic frequency;

(c) computing the actual speed of said induction motor based on the detection signal generated from said needle position detector;

(d) computing an output frequency of said inverter in accordance with an equation given by $$f2=K2\ (na-Nb)+f1$$

where f2 is the output frequency of said inverter, na is the target speed of said induction motor, Nb is the actual speed of said induction motor, f1 is the basic frequency, and K2 is a correction coefficient:

(e) computing an output voltage of said inverter based on the output frequency of said inverter; and (f) outputting the AC driving signal having the output voltage and the output frequency from said inverter.

12. The method according to claim 11, wherein the voltage and the frequency of the AC driving signal has such a predetermined relation that a ratio of a change of the frequency to a corresponding change of the voltage is constant.

13. The method according to claim 11, wherein the sewing machine is a lock stitch sewing machine.

* * * * *